US008606158B2

(12) United States Patent
Havens

(10) Patent No.: US 8,606,158 B2
(45) Date of Patent: Dec. 10, 2013

(54) CHEMICALLY TREATED CLEANING WEB

(75) Inventor: Barry R. Havens, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 156 days.

(21) Appl. No.: 13/271,283

(22) Filed: Oct. 12, 2011

(65) Prior Publication Data

US 2013/0094886 A1 Apr. 18, 2013

(51) Int. Cl.
*G03G 15/20* (2006.01)

(52) U.S. Cl.
USPC ..... 399/327

(58) Field of Classification Search
USPC ..... 399/327, 326, 352; 15/256.5, 256.51, 15/256.52, 256.6
See application file for complete search history.

(56) References Cited

U.S. PATENT DOCUMENTS

| | | | | |
|---|---|---|---|---|
| 7,105,063 | B1 * | 9/2006 | Gibson et al. | 399/327 X |
| 7,462,661 | B2 | 12/2008 | Facci et al. | |
| 7,580,665 | B2 | 8/2009 | Klymachyov et al. | |
| 7,811,737 | B2 | 10/2010 | Facci et al. | |
| 7,953,358 | B2 | 5/2011 | Klymachyov et al. | |
| 2007/0292174 | A1 * | 12/2007 | Klymachyov et al. | 399/327 |

* cited by examiner

*Primary Examiner* — Sophia S Chen
(74) *Attorney, Agent, or Firm* — Hoffman Warnick LLC

(57) ABSTRACT

The present teachings provide a fuser cleaning apparatus that includes a rotatable fuser member and a cleaning web. The cleaning web is impregnated with a chelating agent including citric acid. The cleaning web is translatable and arranged to directly or indirectly contact the rotatable fuser member whereby the citric acid is transferred to the rotatable fuser member to inhibit Zn contamination on the rotatable fuser member.

12 Claims, 2 Drawing Sheets

CHEMICALLY TREATED CLEANING WEB

BACKGROUND

1. Field of Use

This disclosure is generally directed to a method and apparatus for the delivery of chelating agents to improve fuser member life.

2. Background

An image-forming or marking device, includes, but is not limited to, an electrostatographic, electrophotographic and/or xerographic device. In one embodiment, the marking apparatus or device employs a photoconductive component, for example a photosensitive belt or drum. The photoconductive member moves to advance successive portions sequentially through the various processing stations of the marking device disposed about the path of the photoconductive member.

Initially, a portion of the photoconductive surface passes through a charging station. At the charging station, the portion of the photoconductive member is charged, for example, by one or more corona-generating devices to a relatively high, substantially uniform potential.

Next, the charged portion of the photoconductive surface is advanced through an imaging station. At the imaging station, an original document is positioned on a scanning device such as a raster input scanner (RIS), a device known in the art. The RIS captures the entire image from the original document and with an imaging module records an electrostatic latent image on the photoconductive surface of the photoconductive member. The imaging station may include, for example, a raster output scanner (ROS). The ROS lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

Thereafter, the photoconductive member advances the electrostatic latent image recorded thereon to a development station. At the development station, toner is applied to the electrostatic latent image to form a toner powder image on the photoconductive member surface. Any suitable development system may be used including magnetic brush developers, hybrid jumping developers, cloud developers, liquid developers and the like. The toner may be supplied from a developer comprised of the toner and carrier particles, or may be just a liquid or solid toner. Thus, at the development station, developer material is brought near the electrostatic latent image and the latent image attracts toner particles, in some instances, from the carrier granules of the developer material to form a toner powder image on the photoconductive surface.

The toned image on the photoconductive member surface is then advanced to a transfer station where an image-receiving substrate such as a paper sheet is moved into contact with the toner powder image. The toner image is transferred to the image-receiving substrate via any suitable process. Following transfer, the image-receiving substrate is advanced to the fusing station.

It is desirable to increase the life of a fuser member without the requirement of a supplemental cleaning solution.

SUMMARY

According to an embodiment, there is disclosed a fuser cleaning apparatus comprising a rotatable fuser member and a cleaning web. The cleaning web is impregnated with a chelating agent comprising citric acid. The cleaning web is translatable and arranged to directly or indirectly contact the rotatable fuser member whereby the citric acid is transferred to the rotatable fuser member to inhibit Zn contamination on the rotatable fuser member.

According to another embodiment, there is provided a fusing system useful in inhibiting Zn containing contamination in an electrophotographic marking system. The system comprises an impregnated movable cleaning web impregnated with a composition of a surfactant and citric acid and a fuser roll. The web is configured to directly transfer at least a portion of the citric acid to the fuser roll surface. This transfer of citric acid inhibits formation on the fuser roll surface of at least some Zn contamination.

According to another embodiment, there is provided a fusing system that includes an impregnated cleaning web that is impregnated with citric acid and a surfactant. The system includes a fuser roll. The web is configured to indirectly transfer the citric acid and surfactant to the fuser roll. The citric acid and surfactant inhibit zinc contamination from forming on the fuser roll.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Furthermore, to the extent that the terms "including", "includes", "having", "has", "with", or variants thereof are used in either the detailed description and the claims, such terms are intended to be inclusive in a manner similar to the term "comprising." The term "at least one of" is used to mean that one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
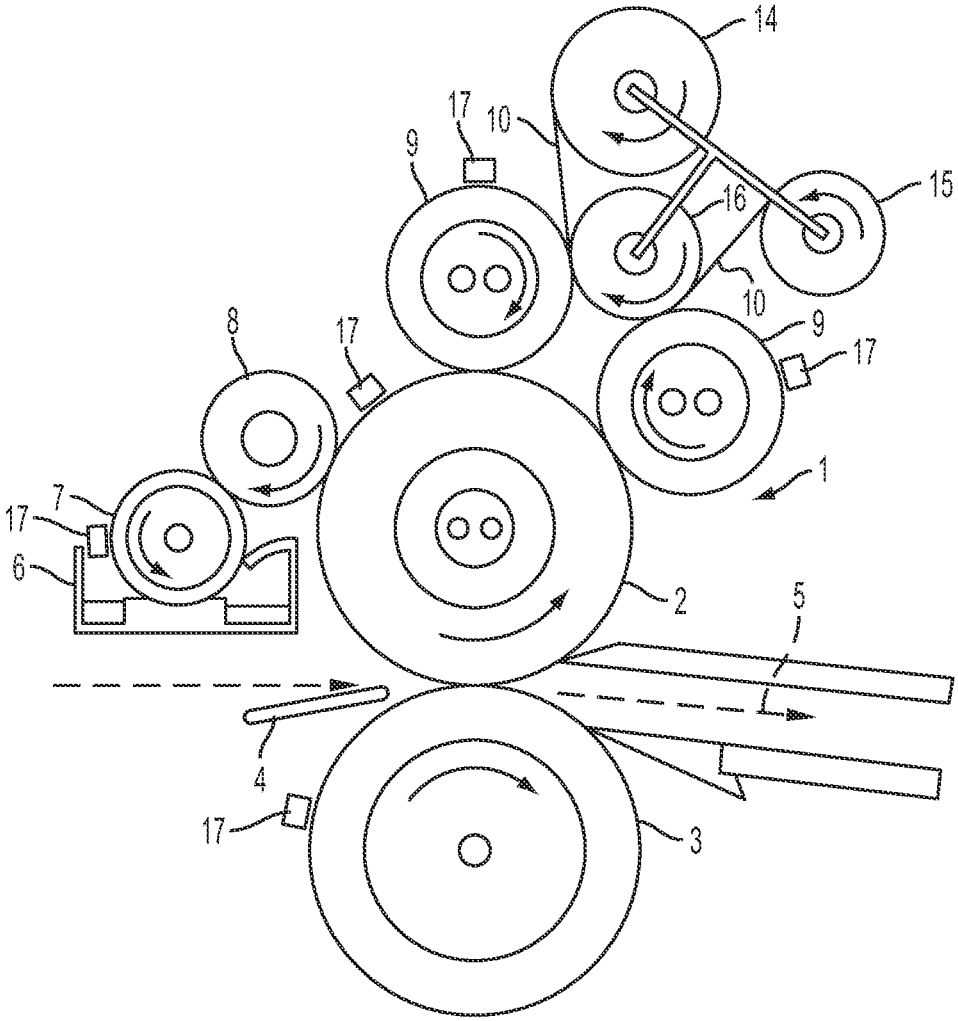
FIG. 1 illustrates a fuser system in an electrostatic marking apparatus using the impregnated fuser cleaning web of this invention.

In FIG. 1, a fuser system 1 is illustrated having a fuser roll 2, a pressure roll 3 and a paper transport 4 which directs a paper-receiving medium 5 through a nip between rolls 2 and 3. The arrows on fuser roll 2 and pressure roll 3 indicate the rotational direction of each roll.

The outer surface of the fuser roll 2 typically includes fluoropolymer particles. Fluoropolymer particles suitable for use in the formulation described herein include fluorine-containing polymers. These polymers include fluoropolymers comprising a monomeric repeat unit that is selected from the group consisting of vinylidene fluoride, hexafluoropropylene, tetrafluoroethylene, perfluoroalkylvinylether, and mixtures thereof. The fluoropolymers may include linear or branched polymers, and cross-linked fluoroelastomers. Examples of fluoropolymer include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP), and mixtures thereof. The fluoropolymer particles provide chemical and thermal stability and have a low surface energy.

Additives and conductive or non-conductive fillers may be present in the surface layer of fuser roll 2. In various embodiments, filler materials or additives including, for example, inorganic particles, can be included with the fluoropolymer particles of the surface layer of fuser roll 2. Conductive fillers used herein include carbon blacks such as carbon black, graphite, fullerene, acetylene black, fluorinated carbon black, and the like; carbon nanotubes; metal oxides and doped metal oxides, such as tin oxide, antimony dioxide, antimony-doped tin oxide, titanium dioxide, indium oxide, zinc oxide, indium oxide, indium-doped tin trioxide, and the like; and mixtures thereof, Certain polymers such as polyanilines, polythiophenes, polyacetylene, poly(p-phenylene vinylene), poly (p-phenylene sulfide), pyrroles, polyindole, polypyrene, polycarbazole, polyazulene, polyazepine, poly(fluorine), polynaphthalene, salts of organic sulfonic acid, esters of phosphoric acid, esters of fatty acids, ammonium or phosphonium salts and mixture thereof can be used as conductive fillers. In various embodiments, other additives known to one of ordinary skill in the art can also be included to form the disclosed composite materials.

A release agent reservoir 6 is shown in operative relationship to a meter roll 7 and a donor roll 8. In operative contact with the fuser roll 2 are two external heat rolls 9 (X-rolls). The X-rolls 9 are both in contact with a cleaning web 10 which is impregnated with a chelating agent or scavenging agent comprising citric acid. It is theorized that salts of citric acid will also work. The citric acid transfers from web 10 to existing X-rolls 9 and from X-rolls 9 to the surface of fuser roll 2. This inhibits formation of debris such as Zn fumarate and other contaminates on the surface of fuser roll 2. The Zn contaminates cause print defects and premature development of offset. By using existing components of the fuser system 1 such as the web 10 and the X-rolls 9, an additional cleaning station as used in some prior art need not be installed in system 1. Since space is always a serious consideration in marking or electrophotographic systems, avoiding the necessity of a cleaning station is important. Also, using the cleaning web 10 and X-rolls 9 to inhibit contamination of the fuser roll 2 avoids the necessity of removing the fuser roll for external cleaning Eliminating or reducing the frequency of the step of removal and cleaning the fusing roll reduces costs. The citric acid is impregnated into web 10 at a level of from about 0.1 $mg/in^2$ to about 30 $mg/in^2$, or from about 0.5 $mg/in^2$ to about 20 $mg/in^2$, or from about 2 $mg/in^2$ to about 10 $mg/in^2$.

Any suitable solution comprising citric acid may be used to impregnate the cleaning web 10. Embodiments of such a solution include citric acid at from about 0.5 weight percent to about 60 weight percent based on the total weight of the solution. In embodiments, the concentration of the citric acid in the solution is from about 2.0 weight percent to about 25 weight percent based on the total weight of the solution, or from about 5 weight percent to about 10 weight percent based on the total weight of the solution. In an embodiment, a suitable surfactant such as 1-methoxy-2 propanol. Other suitable surfactants include 2-butoxyethanol, glycol ethers, polyoxyethylene octyl phenyl ether, ethylene oxide copolymers, propylene oxide copolymers, nonylphenol ethoxylates, octylphenol ethoxylates, secondary alcohol ethoxylates, and seed oil surfactants. The surfactant can be added in an amount of from about 2 weight percent to about 20 weight percent of the solution, or from about 4 weight percent to about 17 weight percent of the solution, or from about 5 weight percent to about 15 weight percent of the solution to improve wetting of the web material. The solution can have a pH of about from 2 to about 8. The impregnated web 10 is supplied from web supply roll 15 and the web moves to web take-up roll 14 for re-use or for replacement. Roll 16 ensures the impregnated web 10 contacts the surface of X-rolls 9 in FIG. 1 or fuser roll 2 in FIG. 2. In FIG. 1, boxes 17 located adjacent rollers 2, 3 and 9 are thermostats.

Figure 2:
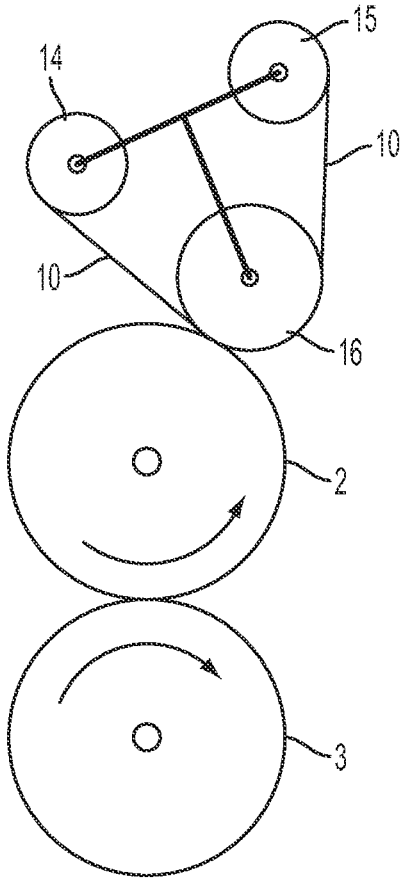
FIG. 2 illustrates a cleaning system where the web directly contacts the fuser roll.

In lieu of the cleaning web 10 contacting the X-rolls, it may be desirable in some embodiments to have the impregnated web 10 directly contact the fuser roll 2 to inhibit or minimize formation of Zn contaminates from the surface of fuser roll 2. In FIG. 2, impregnated web 10 directly contacts fuser roll 2 (as opposed to contacting X-rolls 9 as shown in FIG. 1) to inhibit formation on the fuser surface of Zn fumarate and other contaminates. Otherwise all of the above discussion relating to FIG. 1 equally applies to FIG. 2. In an embodiment the fusing system comprises in an operative arrangement an impregnated cleaning web and a fuser member. The cleaning web is impregnated with a debris inhibiting amount of a metal chelating agent comprising citric acid and/or their salts. Citric acid salts include potassium citrate, sodium citrate and calcium citrate.

In another embodiment the fusing system herein is useful in inhibiting Zn containing contamination in an electrophotographic marking system. The system comprises in an operative arrangement, an impregnated movable cleaning web and a fuser roll. The web is impregnated with a composition of a surfactant and citric acid and adapted to directly or indirectly transfer at least a portion of the citric acid containing composition to said fuser roll surface.

Zinc stearate is present as a toner additive in the iGen toner formulation. The reaction of zinc with residual acids and decomposition products of the toner resin produces a layer of contamination on the fuser roll surface. The contamination is composed of primarily zinc salts (zinc fumarate, zinc terephthalate etc.) and insoluble poly(dimethyl siloxane). The contamination on the surface of iGen fuser rolls results in print defects (axial lines, wavy gloss) and reduced fuser roll life. The citric acid assists to prevent formation on the fuser surface of at least some Zn contaminates. The cleaning web continuously supplies the citric acid directly or indirectly to the fuser roll and inhibits the formation of Zn contaminates on the fuser member surface.

Citric acid solutions can be prepared by dissolving citric acid or its salts in a compatible solvent. Citric acid salts include potassium citrate, sodium citrate and calcium citrate. Compatible solvents include water, ethanol, methanol, isopropanol, other alcohols ethers and polar solvents. The citric acid solutions are a chelating agent. Other similar chelating agents such as tartaric acid, gluconic acid, glycine, proline, terephthalic acid, triethylene tetraamine, glutamic acid, mercaptosuccinic acid and their salts may also be effective treatments. The citric acid solutions-containing solutions are applied to the cleaning web surface and absorbed in the fabric. Citric acid is a material with low-toxicity, as it can be safely ingested, with little risk to those exposed, and is soluble in common solvents that are considered relatively benign (water, ethanol, isopropanol etc).

U.S. Pat. Nos. 7,953,358 and 7,580,665 incorporated by reference herein in their entirety, disclose a cleaning web impregnated with chelating agents. The patents show that applying a chelating agent such as EDTA assists in the prevention of zinc contamination on surface of a fuser member.

The embodiments described herein can be used to reduce the number of fuser rolls that fail prematurely due to contamination. Changes to the machine design, other than the use of a treated cleaning web, are not be required. Current remanufacturing and repairing (sanding to remove contamination) is costly and requires the removal of the fuser roll.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function.

EXAMPLES

Test A.

Sample fuser rolls were prepared and characterized by ATR-FTIR. Axial gelation (zinc fumarate and insoluble PDMS) on the roll surface was cleaned with two treatments: 1) Scrubbing Bubbles Automatic Shower Cleaner and a mixture of EDTA, 2-butoxy ethanol and water. Spectra were collected in the treated regions and compared with an untreated region.

Test B.

A cleaning experiment was also performed on fuser members that had severe axial gelation contamination. For this experiment, solutions of citric acid in water, methanol and ethanol were prepared and wiped onto the roll surface. The treated areas were then rinsed with water and wiped dry with a paper towel. Spectra were collected of the treated and untreated areas for comparison.

The spectra collected from both of the experiments were then run through a macro to measure the peak intensities associated with PDMS (2962 $cm^{-1}$), XP-777 (1722 $cm^{-1}$) and zinc fumarate (1545 $cm^{-1}$). The values reported were normalized. Spectral overlap exits for the XP-777 carbonyl and the Viton double bonds at 1722 $cm^{-1}$, which varies from roll to roll. Because of this, reported XP-777 raw absorbance values are actually the combined double bond and carbonyl absorbance values. Table 1 below summarizes the results.

TABLE 1

| Fuser | Treatment | PDMS | XP-777 | ZnFu |
|---|---|---|---|---|
| Test A | No treatment | 0.043 | 0.035 | 0.047 |
| Test A | Scrubbing Bubble Automatic Shower Cleaner | 0.034 | 0.031 | 0.013 |
| Test A | EDTA, 2-butoxy ethanol and water | 0.026 | 0.029 | 0.011 |
| Test B | No treatment | 0.071 | 0.126 | 0.636 |
| Test B | Citric acid-ethanol solution treatment | 0.015 | 0.037 | 0.007 |
| Test B | Citric acid-methanol solution treatment | 0.022 | 0.044 | 0.009 |
| Test B | Citric acid-water solution treatment | 0.016 | 0.038 | 0.007 |

ATR-FTIR spectra of the two roll with axial gelation compared with Viton, XP-777, Zinc fumarate and PDMS reference spectra. In Test B, the fuser had a much greater quantity of zinc fumarate and insoluble PDMS present on the surface of the roll. The test showed that citric acid is as effective as EDTA in cleaning the surface of a fuser roll.

In further testing, a solution of 10 weight percent citric acid in ethanol was shown to remove zinc-containing contamination from a hot iGen fuser in-situ. The fuser roll was producing axial line print defects due to the contamination on the fuser roll surface. An area of the roll was cleaned with the solution while the roller was still was hot. The print defect was no longer present in the region that corresponded to the cleaning, and the print defect remained absent for an additional 10,000 prints, at which point the test was stopped.

Citric acid has been show to be an effective cleaning agent on fuser rolls both in the machine, and when removed from the machine. Infrared spectroscopy was utilized to assess the cleaning ability of solutions of citric acid prepared in ethanol, water and methanol solvents on contaminated fuser rolls that had been removed from the machine and were cold. Results from the experiment revealed that the citric acid was as effective as other chelating agents, such as EDTA.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled the in the art which are also encompassed by the following claims.

What is claimed is:

1. A fuser cleaning apparatus comprising:

a rotatable fuser member;

a cleaning web, the cleaning web being impregnated with a composition consisting of: citric acid and an optional surfactant, the cleaning web being translatable, and the cleaning web being arranged to directly or indirectly contact the rotatable fuser member whereby the citric acid is transferred to the rotatable fuser member to inhibit Zn contamination on the rotatable fuser member.

2. The fuser cleaning apparatus according to claim 1, wherein the cleaning web is heated.

3. The fuser cleaning apparatus according to claim 1, wherein the fuser member is heated.

4. The fuser cleaning apparatus according to claim 1, wherein the citric acid is impregnated in the web at an amount of from about 0.1 $mg/in^2$ to about 30 $mg/in^2$.

5. A fusing system useful in inhibiting Zn contamination in an electrophotographic marking system, said system comprising:

an impregnated movable cleaning web impregnated with a composition consisting of: citric acid and an optional surfactant; and a fuser roll, wherein said web is configured to directly or indirectly transfer at least a portion of said composition to a surface of said fuser roll thereby continuously inhibiting formation on said surface of the fuser roll of at least some Zn contamination.

6. The system according to claim 5 wherein said web is in contact with at least one external heat roll and wherein each external heat roll(s) is configured to operatively contact said fuser roll.

7. The system according to claim 5, wherein the citric acid is impregnated in the web at an amount of from about 0.1 $mg/in^2$ to about 30 $mg/in^2$.

8. The system according to claim 5 wherein said web is configured to be in operative continuous contact with two external heat rolls and configured to thereby transfer at least a cleaning amount of said composition to said external heat rolls, said external heat rolls configured to contact said fuser roll and configured to transfer at least a portion of said composition to a surface of said fuser roll.

9. The system according to claim 5 wherein said fuser roll is configured to continuously contact a marked receiving member, and wherein said composition treated fuser roll is configured to minimize transfer of toner decomposition products to said fuser roll and said receiving member.

10. The system according to claim 5 wherein said fuser roll is configured to minimize transfer of Zn contamination from said fuser roll to a marked receiving member.

11. A fusing system comprising;

an impregnated cleaning web, said web impregnated with a composition consisting of: citric acid and a surfactant;

a fuser roll, wherein said web is configured to indirectly transfer said citric acid and said surfactant to said fuser roll, said citric acid and said surfactant configured to continuously inhibit zinc by-products and contamination from forming on said fuser roll, and wherein at least a portion of said citric acid is configured to be transferred from said web to at least one external heat roll, and wherein said citric acid is configured to be subsequently contacted with a surface of said fuser roll.

12. The system according to claim 11, wherein the citric acid is impregnated in the web at an amount of from about 0.1 $mg/in^2$ to about 30 $mg/in^2$.

* * * * *